United States Patent [19]

Boyanton

[11] Patent Number: 4,492,364

[45] Date of Patent: Jan. 8, 1985

[54] CHAIN LINK FENCE SYSTEM

[75] Inventor: Walter L. Boyanton, Houston, Tex.

[73] Assignee: Innovative Research and Development Co., Houston, Tex.

[21] Appl. No.: 523,838

[22] Filed: Aug. 17, 1983

[51] Int. Cl.[3] ..... B21F 27/00

[52] U.S. Cl. ..... 256/47; 256/32

[58] Field of Search ..... 256/47, 57, 32, 48; 403/397

[56] References Cited

U.S. PATENT DOCUMENTS

| | | | |
|---|---|---|---|
| 1,023,509 | 4/1912 | Downs | 256/57 |
| 1,979,866 | 11/1934 | Chapman | 256/32 |
| 2,702,182 | 2/1955 | Wenger | 256/48 |
| 2,907,553 | 10/1969 | Cookman | 256/48 X |
| 2,996,285 | 8/1961 | Johnson | 256/47 |
| 3,370,836 | 2/1968 | Ashworth et al. | 256/47 |

FOREIGN PATENT DOCUMENTS

| | | | |
|---|---|---|---|
| 403595 | 5/1967 | Australia | 256/32 |
| 287326 | 3/1928 | United Kingdom | 256/57 |

*Primary Examiner*—Andrew V. Kundrat

*Attorney, Agent, or Firm*—Neal J. Mosely

[57] ABSTRACT

A chain link fence system has end, corner, or gate posts, each comprising a tubular metal post with a vertically extending concave groove along at least one side thereof and retaining bands across said groove and a horizontal slot near the top end of the post. A supporting cross bar extends from end, corner, or gate post to end, corner, or gate post and has a horizontally positioned apertured tongue member at each end. The tongue member is positioned in the top slot of the post with the aperture aligned with the vertically extending groove. The end links of a chain link fence are positioned in the vertically extending groove. A retaining rod is inserted downwardly along the tubular post through the aperture in the tongue member, in the groove and beneath the retaining bands and through the end links of chain link fence to secure the cross bar and the chain link fence wire to the post. A cap member covers the top of the post. The chain link fence is preferably secured to intermediate line posts by a novel retaining wire tie. The wire tie is of a heavy bendable wire having the initial shape of a shepherd's crook and is self closing at the crook end when properly installed.

15 Claims, 6 Drawing Figures

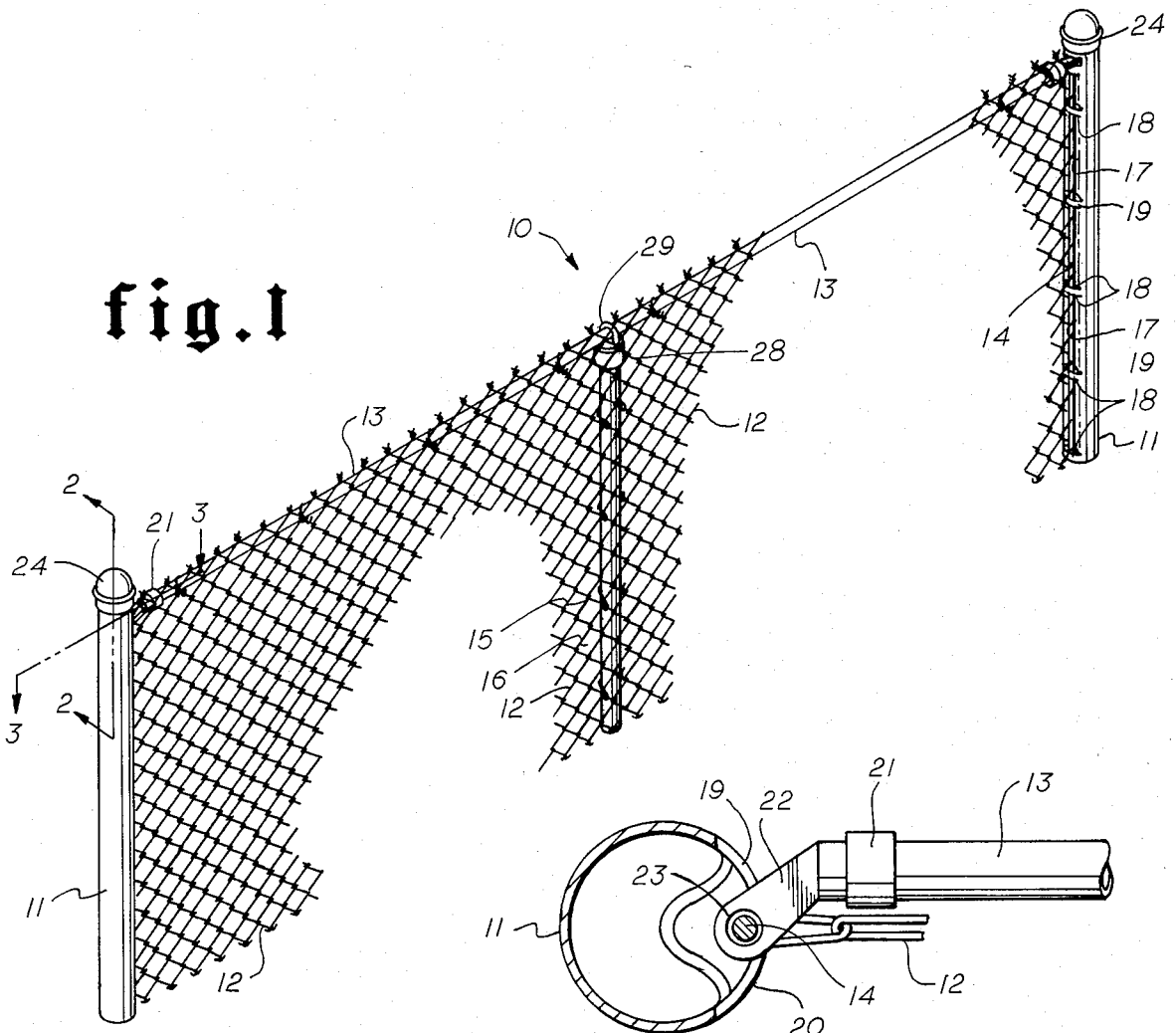
fig.1
fig.3
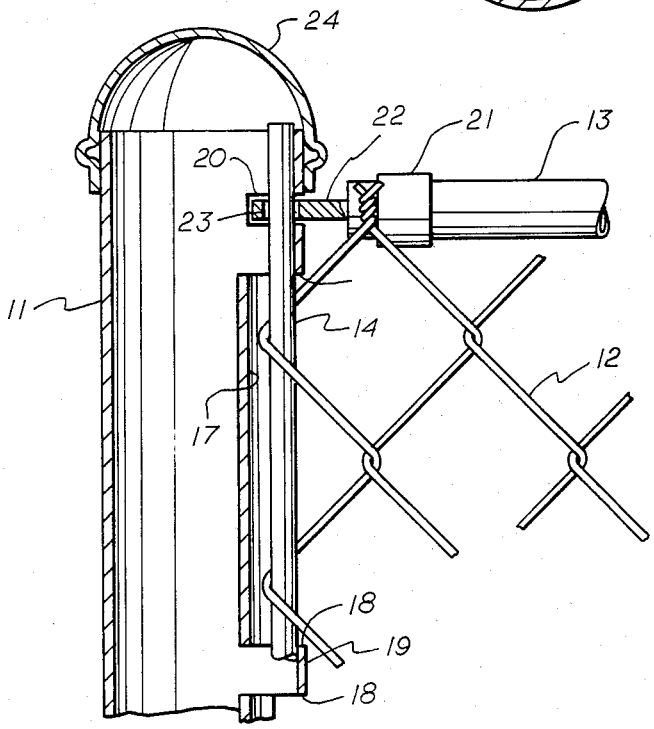
fig.2

CHAIN LINK FENCE SYSTEM

BACKGROUND OF THE INVENTION

1. FIELD OF THE INVENTION

This invention relates generally to chain link metal fence systems having end, corner, or gate posts of novel construction for ease of assembly of the ends of the fence thereto.

2. DESCRIPTION OF THE PRIOR ART

A major cost factor in the installation of chain link fences is the time and labor required to hand assemble the many clamps and connecting hardware. The conventional chain link fence system basically comprises a section of chain link fencing material stretched and secured between two tubular fence posts. A metal rod or bar is inserted vertically through the end links ends of the fencing parallel to the post and is secured to the post by a series of strap type clamps encircling the post and the bar. A nut and bolt arrangement fastens the two ends of each clamp together. The number of clamps required depends upon the length of the post.

A cross bar comprising a section of tubing having a cap at each end is clamped between the posts near the top edge of the fence material. The cross bar end caps are provided with a flat rectangular lug having a hole for clamping to the post by straps as previously described. Wire ties are bent partially around the cross bar and each end is twisted around a strand of the fence material to secure the material to the cross bar and to intermediate posts. The process of fastening the many nuts, bolts and ties is very tedious, time consuming, and expensive. In addition, conventional posts are insecure in that they can be opened easily by disconnection of the clamps.

There are several patents which disclose other fence systems including means for easy assembly.

Engstrom, U.S. Pat. No. 751,622 discloses a fence post having a recessed area for receiving a clamping rod. The clamping rod is held in place by a plurality of eye-bolts through the eyes of which the clamping rod extends. Tightening of the nut of the eye-bolt draws the clamping rod into the recess, bending and clamping the wire runners therein.

Jones, U.S. Pat. No. 1,150,373 discloses a tubular fence post having retaining leaves struck outwardly to provide spaces between the respective retainers and the body of the tubular post. After the wires are in position, a key or holder is inserted through the spaces to hold the wire in place. The post shown is an intermediate post, not an end, corner, or gate post, for a rectangular grid wire fence. The post is not designed for use as an end, corner, or gate post and does not provide a recessed and protected connection.

Gerken, U.S. Pat. No. 1,160,709 discloses a fence post having extending hooks and tongues for receiving a tie or retaining rod. The posts are intermediate posts, not end, corner, or gate posts, and do not provide a recess to receive and protect the rod.

James, U.S. Pat. No. 1,330,809 discloses a metallic fence post (intermediate post, not an end, corner, or gate post) which has depressed or concave grooved sections between straps or bands. The straps are used to secure single strand fencing, e.g. barbed wire fencing, by hog-ring clips and are not used for chain link fencing.

Ashworth et al U.S. Pat. No. 3,370,836 discloses a chain link fence having an end, corner, or gate post or corner post with expanded strips providing apertures with the same spacing as the fence links. The end links of the fence are secured to the apertures provided by the expanded strips by a serpentine wire interconnecting the end links thereto.

Bishop, U.S. Pat. No. 3,502,303 discloses an intermediate (not an end, corner, or gate post) fence post having horizontal slots for receiving individual wires of single strand wire fencing. A locking rod or wire is vertically extended between the wires and the interior of the post to hold them in place.

Muckelrath, U.S. Pat. No. 4,058,882 discloses a metal post of angle iron or hollow square construction having holes punched along the corners thereof. The posts are intermediate posts for wire fencing comprising a plurality of separate single strands. A retaining tie wire is placed through the hole after engagement with each individual fence wire and twisted to hold the wire in place.

The prior art in general, and none of these patents in particular, disclose a chain link fence system having tubular metal end, corner, or gate posts with provision for quick connection thereon and assembly without the need for connecting a plurality of separate connecting straps.

SUMMARY OF THE INVENTION

One object of this invention to provide a chain link fence system which eliminates the need for hand assembled clamp members.

Another object of this invention is to provide a chain link fence system which is economical to manufacture.

Another object of this invention is to provide a chain link fence system which is easily and quickly installed.

Another object of this invention is to provide a chain link fence system which has improved fence wire attachment structure associated therewith.

Another object of this invention is to provide a chain link fence system which has end, corner, or gate posts providing for quick attachment of the fence cross bars and the end fence links thereto by means of a single securing rod locking the end links and end of the cross bar in slots recessed in the end, corner, or gate post.

Other objects of the invention will become apparent from time to time throughout the specification and claims as hereinafter related.

The above noted objects and other objects of the invention are accomplished by a chain link fence system having end, corner, or gate posts, each comprising a tubular metal post with a vertically extending concave groove along one side thereof and retaining bands across said groove and a horizontal slot near the top end of the post. A supporting cross bar extends from end, corner, or gate post to end, corner, or gate post and has a horizontally positioned apertured tongue member at each end. The tongue member is positioned in the top slot of the post with the aperture aligned with the vertically extending groove. The end links of a chain link fence are positioned in the vertically extending groove. A retaining rod is inserted downwardly along the tubular post through the aperture in the tongue member, in the groove and beneath the retaining bands and through the end links of chain link fence to secure the cross bar and the chain link fence wire to the post. A cap member covers the top of the post. The chain link fence is preferably secured to intermediate line posts by a novel retaining wire tie. The wire tie is of a heavy bendable wire having the initial shape of a shepherd's crook and is self closing at the crook end when properly installed.

BRIEF DESCRIPTION OF THE DRAWINGS

FIG. 1 is an isometric view of a preferred fence system having end, corner, or gate posts constructed for easy and quick connection of chain link fencing.

FIG. 2 is a vertical cross section view taken along lines 2—2 of FIG. 1 showing the quick connection of the chain link fencing.

FIG. 3 is a horizontal cross section view taken along lines 3—3 of FIG. 1.

DESCRIPTION OF THE PREFERRED EMBODIMENT

Figure 4:
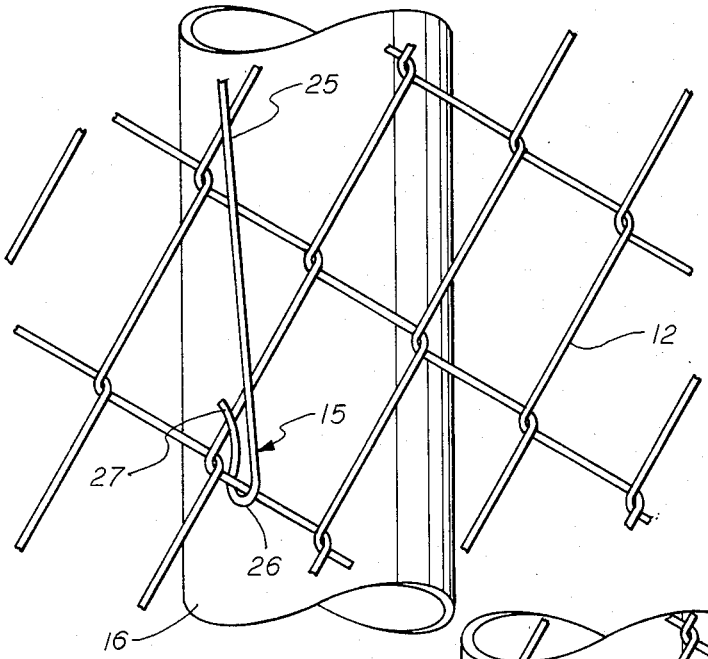
FIGS. 4, 5, and 6 are partial views, in elevation, of a portion of the fence system illustrating the sequence of attaching the fence material to a supporting post by means of a novel tie wire.

Referring to the drawings by numerals of reference, and more particularly to FIG. 1, there is shown a preferred chain link fence system 10. The fence system 10 comprises tubular metal end fence posts 11, metal chain link fence 12, a cross bar member 13, a retainer rod 14, wire tie members 15 and, depending on the length of the fence, may include one or more conventional tubular metal intermediate posts 16.

Each tubular metal end, corner, or gate post 11 has one to four vertically disposed concave grooves 17 depressed between adjacent transverse horizontal slits 18 to define a series of vertically aligned retaining bands 19. One groove is used on an end or gate post, while two, three, or four grooves are used on corner posts. The retaining bands 19 have the same curvature as the cylindrical surface of the tubular post 11. A horizontal slot 20 is located near the top end of the post 11. The groove(s) 17 and slot 20 are formed by slitting a tubular post blank and creasing the wall of the blank to provide grooves 17 separated by retaining bands 19 and creasing the intermediate material in slot 20 inward as shown in FIGS. 2 and 3. In corner posts, two, three, or four sets of grooves 17, bands 19, and slots 20 are provided, spaced 90° apart circumferentially on the post.

Each end of the tubular cross bar member 13 is provided with an end cap 21. End caps 21 have one end of tubular shape sized to fit tightly over the ends of the tubular cross bar 13 and another end comprising an outwardly extended flat tongue portion 22 having a hole or aperture 23. An equivalent structure, such as an eye-bolt protruding from tubular cap 21 could be used.

In conventional chain link fence systems, end caps are used on cross bars, but their tongues are turned with the flat surface being vertical and the hole horizontal to the adjoining post so that a clamp may be placed on the post and its ends bolted through the hole in the tongue. In the present invention, the end caps 21 are turned with the flat surface of the tongue 22 being horizontal and the hole 23 vertical so that the tongue 22 may be inserted into the horizontal slot 20 with the tongue or eye of end cap 21 aligned with the groove(s) 17 and the retaining bands 19.

A retainer rod 14 having a length approximately the same as the length of the post 11 above the ground and its diameter sufficient to fit through the hole 23 in the tongue 22 and the space between groove(s) 17 and bands 18 is provided to secure the ends of the fence material 12 to the posts 11.

Wire tie members 15 are provided to further secure the chain link fence material 12 to the cross bars 13 and other support members, such as conventional tubular metal intermediate posts 16. The wire ties 15 are of a heavy gage bendable wire having the shape of a shepherd's crook. The wire ties 15 have one straight end 25 and which is rebent or generally J-shaped as at 26 merging into a shorter and outwardly curved leg 27 (FIG. 4). This design of tie wire is self closing when properly assembled as described below.

ASSEMBLY AND OPERATION

End, corner, or gate posts 11 are conventionally placed and set in concrete at the ends or corners of the fence line. The appropriate length of chain link fence material 12 is measured and cut with the ends forming a series of closed loops. The fencing is cut somewhat shorter than the distance between the end, corner, or gate posts 11 and is stretched tightly when installed. Cross bar members 13 are measured and cut and end caps 21 are placed on each end with the flat portion of the tongues or eyes 22 positioned to fit into the slot 20. The tongues 22 are inserted into the slots 20 from the side. With the cross bar 13 temporarily in position, the closed or end loops of one side of the fence material 12 are placed into the groove 17 and the retainer rod 14 is inserted downwardly along the tubular post 11 in the groove 17 behind the retaining bands 19. In fencing of any substantial length, conventional tubular metal intermediate posts 16 are placed between the posts 11. These posts preferably have top caps 28 with top loops 29 which receive and guide the cross bar 13.

The retainer rod 14 is passed through the hole 23 in the tongue or eye 22 of the end cap 21 and through the closed loops of the fence material 12 and comes to rest on the concrete anchor or on the earth. The top end of the retainer rod 14 should be even with or slightly below the top of the post 11. Conventional top caps 24 are placed over the top end of the post 11 to secure the retainer rod 14 in position within the post 11. The fence material 12 is then stretched to position the closed end loops or links at the opposite end of the fence in the groove 17 on the opposite end or corner post 11. The opposite end on cross bar 13 has been placed with the tongue or eye 22 positioned in the slot 20 of the opposite end or corner post 11, as described above. Another retainer rod 14 is then passed through the hole 23 in the tongue or eye 22 and through the closed end loops of the opposite end of the fencing and come to rest on the concrete anchor or on the earth. This secures the fencing in a stretched state between the tow end or corner posts 11 and abutting the intermediate posts 16.

Figure 5:
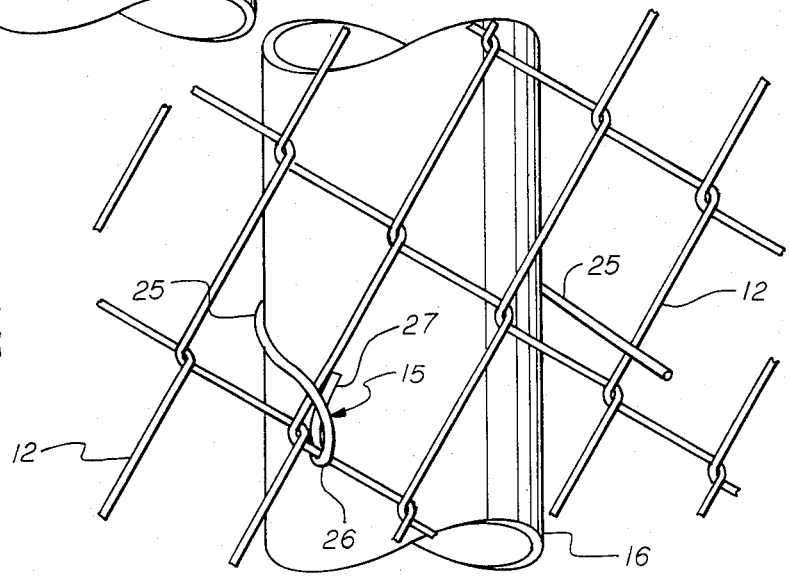
Figure 6:
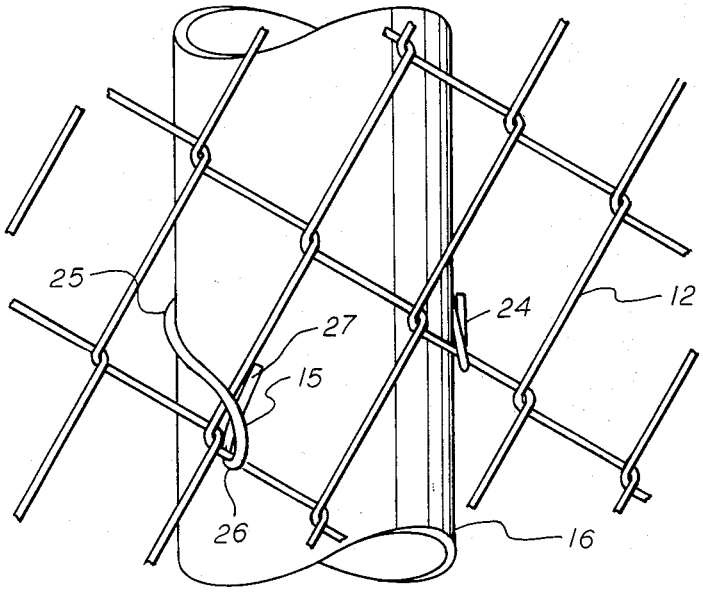

Referring now to FIGS. 4, 5, and 6, the wire ties 15 are illustrated as being used to attach the fence material 12 to an intermediate post 16 or to attach the top portion of the fence material 12 to the cross bar 13.

The J-shaped portion 26 of the wire tie 15 is inserted onto the fence material 12 at or near a point where the strands are twisted around each other. The J-shaped portion 26 of the tie wire 15 is placed onto one strand of the fence material 12 and the curved portion 27 is resting on the same strand. The long leg 25 of the tie wire 15 is bent toward the curved portion 27 as it is bent around the intermediate post 16 (or cross bar 13). This causes the J-shaped curved portion to close on itself to form a tightly closed loop (FIGS. 5 and 6).

The remaining portion of the straight leg 25 of the tie wire 15 is then bent around the cross bar 13 or post 16 until it emerges back through the fence material 12 (FIG. 5). In this position, the bending of the tie 15 has closed the J-shaped portion 26 securely around a strand of the fence material 12. The remaining portion of the straight leg 25 of the tie 15 is then twisted around a strand of the fence material nearest to the cross bar or post 16 (FIG. 6). In this manner the ties 15 are applied quickly with very little wasted motion and require only one twisting operation.

It will be obvious to those skilled in the art that the present fence system eliminates the need for hand assembly of nuts, bolts, and clamps as used in conventional chain link fences and thus is very fast and effective and reduces the time and labor required for erection.

While this invention has been described fully and completely with special emphasis upon a preferred embodiment, it should be understood that within the scope of the appended claims the invention may be practiced otherwise than is specifically described herein.

I claim:

1. A chain link fence system comprising a pair of end, corner, or gate posts anchored vertically in the earth in laterally spaced relation, a cross bar extending between the upper ends of said posts and secured thereon, and a chain link fence material extending between and secured at opposite ends to said posts, in which each of said posts comprises a tubular metal post having a series of vertically aligned retaining bands spaced longitudinally thereof with narrow openings extending between said bands in vertical linear relation, said openings receiving the opposite end portions of said chain link fence material, an opening on the surface of the top portion of said post in vertical alignment with said first named openings and retaining bands to receive one end of said cross bar member, said cross bar member having opposite end portions, each sized to fit into said last named opening and having a hole positioned vertically when installed in said last named opening, and a retaining rod inserted downwardly through said hole in the end of said cross bar member behind said bands and through the end loops of the respective ends of the chain link fence material, thereby securing said cross bar and chain link fence material to each of said posts.

2. A chain link fence system according to claim 1 in which said chain link fence material is stretched between said posts and said retaining rods are restrained against withdrawal by the tension of said fence material.

3. A chain link fence system according to claim 2 including at least one intermediate post anchored vertically in the earth between said end, corner, or gate posts and adjacent to said stretched fence material, and said fence material being secured by bendable wire ties to said intermediate post and said cross bar.

4. A chain link fence system according to claim 3 in which said wire tie members are of heavy gage bendable wire having an initial shape approximating the shape of a shepherd's crook with one straight leg and a rebent generally J-shaped portion and terminating in a shorter leg having an outwardly curved portion.

5. A chain link fence system according to claim 1 in which said tubular metal end, corner, or gate posts each have vertically disposed concave grooves depressed between adjacent transverse horizontal slits to define said vertically extending openings and said retaining bands, said retaining bands lying on a common cylindrical surface with the cylindrical surface of said post, and said retaining rods being positioned in said grooves in said end, corner, or gate posts behind said bands and extending respectively through the end loops at opposite ends of said fence material.

6. A chain link fence system according to claim 1 in which said hole at the top of said post comprises a horizontal slot, said cross bar has cap members at each end with flat extensions thereon, each having a hole therethrough, and positioned in said top slot with said hole aligned vertically to receive said retaining rod.

7. A chain link fence system according to claim 5 in which said cross bar has cap members at each end with flat extensions thereon, each having a hole therethrough, and positioned in said top slot with said hole aligned vertically with said groove to receive said retaining rod,

8. A chain link fence system according to claim 6 in which said chain link fence material is stretched between said end, corner, or gate posts and said retaining rods are restrained against withdrawal by the tension of said fence material.

9. A chain link fence system according to claim 8 in which at least one intermediate post anchored vertically in the earth between said end, corner, or gate posts and adjacent to said stretched fence material, and said fence material being secured by bendable wire ties to said intermediate post and said cross bar.

10. A chain link fence system according to claim 9 in which said wire tie members are of heavy gage bendable wire having an initial shape approximating the shape of a shepherd's crook with one straight leg and a rebent generally J-shaped portion and terminating in a shorter leg having an outwardly curved portion.

11. A kit of materials for assembly into a chain link fence system comprising a plurality of tubular metal end, corner, or gate posts having one to four longitudinally extending concave grooves depressed between adjacent transverse slits to define a series of longitudinally spaced retaining bands, said concave grooves being adapted to receive the end loops of a length of chain link fence wire, said retaining bands lying on a common cylindrical surface with the cylindrical surface of said post, an opening on the curved surface of said post in alignment with said grooves and retaining bands to receive one end of a cross bar member, a cross bar member having at least one end provided with a hole and adapted to be received by said opening, and a retaining rod adapted to be inserted downwardly through said hole in said cross bar member and between said grooves and bands and through portions of chain link fence wire, thereby securing said cross bar and said chain link fence wire to said post.

12. A kit of materials according to claim 11 in which said opening in said post comprises a laterally extending slot in the surface thereof in alignment with said grooves and retaining bands, said cross bar has the opposite ends thereof provided with end cap members, each having tongue portions extending therefrom with a hole therein, and adapted to be positioned in said top slot with said hole aligned vertically to receive said retaining rod.

13. The method of erecting and securing a wire fence comprising the steps of;

placing and setting in the ground, in spaced relation, least two tubular metal fence end, corner, or gate posts, each of said posts having one to four vertically disposed concave grooves depressed between adjacent transverse horizontal slits to define a series of vertically aligned retaining bands and a horizontal slot near its top end in vertical alignment with said grooves and retaining bands, said posts being positioned with one of said grooves in one post facing a groove in the other, measuring and cutting a length of chain link fence material slightly less than the distance between said posts with the ends thereof forming a series of closed loops, measuring and cutting cross bar members to fit the distance between said end, corner, or gate posts, installing end caps having a flat tongue portion containing a hole on opposite ends of said cross bar with the flat portions of the tongues in horizontal alignment with the slots in said posts, inserting the tongue portions of the end caps into the slots in the respective posts to temporarily position the cross bar, placing the closed loops of one end of the chain link fence material into the groove in one post, inserting a retainer rod downwardly along said one tubular post through the hole in the tongue of the end cap, between the grooves and the retaining bands, and through the closed loops of the chain link fence material, stretching the chain link fence material to place the closed loops of the other end thereof into the grooves in the other end, corner, or gate post, inserting another retainer rod downwardly along said other tubular post through the hole in the tongue of the end cap, between the grooves and the retaining bands, and through the closed loops of the chain link fence material to secure said fence in a stretched condition, placing a top cap over the top end of each end, corner, or gate post to retain each retainer rod in position within the respective post, inserting the J-shaped portion of a wire tie member, having the shape of a shepherd's crook, onto one strand of the fence material at or near a point where the strands of the fence are twisted around each other, and the curved portion of the wire tie is resting on the same strand after the strand makes a 90° bend, bending the remaining straight leg of the wire tie around the cross bar or the intermediate post until it emerges back through the fence material thereby closing the J-shaped portion securely around the strand of the fence material, and twisting the remaining straight portion of the wire tie around a strand of the fence material nearest to the cross bar or support structure.

14. An end, corner, or gate post for a chain link fence system comprising a tubular metal post having longitudinally extending concave grooves depressed between adjacent transverse slits to define a series of longitudinally spaced retaining bands, said concave grooves being of a size adapted to receive the end loops of a length of chain link fence wire, said retaining bands having the same cylindrical curvature as the surface of said post, a slot opening on the curved surface of said post adjacent to one end thereof in alignment with said grooves and retaining bands of a size adapted to receive an apertured end of a cross bar member, and said grooves and bands providing a longitudinally disposed passage adapted to receive a retaining rod passing through an aperture in a cross bar member and the end loops of a chain link fence for securing the same together.

15. A tie wire for a chain link fence system comprising a heavy gage bendable wire having an initial shape approximating the shape of a shepherd's crook with one long straight leg and a short leg bent back along said straight leg and connected thereto by a curved portion forming a generally J-shaped construction, the intermediate portion of said short leg being curved from said curved portion first inwardly toward said straight leg and then outwardly away from said straight leg so that the the end of said short leg is further away from said straight leg than said intermediate portion, said tie wire being self-closing when said J-shaped portion is hooked over a fence wire and said straight leg is bent in the direction of the J-shaped end and around an object to which the tie is to be secured.

* * * * *